US005842092A

United States Patent [19]

Jyoroku

[11] Patent Number: 5,842,092

[45] Date of Patent: Nov. 24, 1998

[54] TONER CARTRIDGE AND TONER LEAKAGE PREVENTING TAPE

[75] Inventor: Kazuo Jyoroku, Osaka, Japan

[73] Assignee: Mita Industrial Co., Ltd., Osaka, Japan

[21] Appl. No.: 892,099

[22] Filed: Jul. 14, 1997

[30] Foreign Application Priority Data

Jul. 23, 1996 [JP] Japan ..... 8-193016
Jul. 23, 1996 [JP] Japan ..... 8-193017

[51] Int. Cl.[6] ..... G03G 15/08

[52] U.S. Cl. ..... 399/262; 399/103

[58] Field of Search ..... 399/119, 258, 399/262, 102, 103, 105, 106; 222/DIG. 1

[56] References Cited

U.S. PATENT DOCUMENTS 5,235,389 8/1993 Kikuchi et al. ..... 222/DIG. 1 X
5,548,384 8/1996 Weed ..... 399/106 X
5,722,019 2/1998 Nakajima ..... 399/262
5,722,020 2/1998 Matsuoka et al. ..... 399/262

*Primary Examiner*—S. Lee
*Attorney, Agent, or Firm*—Beveridge, DeGrandi, Weilacher & Young L.L.P.

[57] ABSTRACT

A toner cartridge includes a container having a toner discharge opening formed therein, and an external member combined with the container so as to be relatively movable between a closed position at which the external member closes the toner discharge opening and an open position at which the external member uncovers the toner discharge opening. A compressible seal member extending along the peripheral edge of the toner discharge opening is disposed on the outer surface of the container. The seal member is compressed between the outer surface of the container and the inner surface of the external member. The seal member has a surface layer of cloth. A toner leakage preventing tape is stuck to a required site of the inner surface of the external member. The surface of the toner leakage preventing tape is non-adherent and has a coefficient of static friction $\mu_0$, against the surface of a glazing, of 3.5 to 4.5, preferably 3.8 to 4.2.

14 Claims, 3 Drawing Sheets

TONER CARTRIDGE AND TONER LEAKAGE PREVENTING TAPE

FIELD OF THE INVENTION

This invention relates to a toner cartridge to be applied to a developing device for developing a latent electrostatic image to a toner image in an image forming machine such as a copier, a printer or a facsimile. The invention also concerns a toner leakage preventing tape which is preferably applicable to, although not restricted to, a toner cartridge.

DESCRIPTION OF THE PRIOR ART

In an electrostatic image forming machine, as is well known, a latent electrostatic image is formed on an electrostatic photoconductor, and developed to a toner image by a developing device. The developing device applies a toner to the latent electrostatic image to develop it to the toner image. Usually, the developing device includes a toner cartridge to be mounted detachably for supplying a toner to be consumed. A typical example of the toner cartridge is of the type having a container and an external member combined therewith. The toner is accommodated in the container, and a toner discharge opening is formed in the container. The external member is mounted on the container so as to be relatively movable between a closed position and an open position. Until the toner cartridge is mounted at a required site of the developing device, the external member is located at the closed position, and the toner discharge opening of the container is closed with the external member. When the external member is moved from the closed position to the open position, the toner discharge opening is uncovered, whereupon the toner accommodated in the container is discharged to the required site of the developing device.

When the external member is situated at the closed position, it is important that the toner discharge opening of the container be closed fully tightly. Otherwise, the toner, a fine powder, will leak from the toner cartridge to the surroundings. Usually, therefore, a seal sheet for covering the toner discharge opening is bonded strippably to the outer surface of the container to seal the toner discharge opening. A part of the seal sheet is connected to the external member. Thus, when the external member is moved from the closed position to the open position, the seal sheet is stripped from the outer surface of the container in accordance with this movement of the external member to unseal the toner discharge opening. The unsealed toner discharge opening remains open. The toner cartridge using the seal sheet may involve the following problems, particularly if it is of the type in which the container and the external member are both nearly cylindrical, and the container is inserted into the external member concentrically: It requires a considerably complicated procedure to bond the seal sheet to the outer surface of the container in such a manner as to cover the toner discharge opening formed in the peripheral surface of the container and connect a part of the seal sheet to the external member. Because of this complicated procedure, the manufacturing cost for the toner cartridge is considerably increased.

Instead of using the above-described seal sheet, it has been proposed to dispose on the outer surface of the container a compressible seal member extending along the peripheral edge of the toner discharge opening. The compressible seal member may be formed of a plastic foam such as polyurethane foam. With the toner cartridge of such a construction, when the external member is situated at the closed position, the toner discharge opening is sealed by the action of the external member closing the toner discharge opening as well as the seal member compressed between the outer surface of the container and the inner surface of the external member. The seal member can be disposed relatively easily on the outer surface of the container by using, say, an adhesive double coated tape. Thus, the aforementioned problems with the use of the seal sheet can be solved.

According to the inventor's experience, however, the toner cartridge having the compressible seal member disposed, particularly, on the outer surface of the container poses the following drawback: Assume that the sealing of the toner discharge opening is not necessarily full, while the external member is lying at the closed position. When considerable vibrations are exerted during transportation, for example, some toner tends to leak from the toner cartridge.

In the toner cartridge having the compressible seal member disposed on the outer surface of the container, moreover, the seal member is compressed between the outer surface of the container and the inner surface of the external member. Hence, resistance when moving the external member relative to the container is markedly high. The relative movement of the external member which is made usually by hand is considerably difficult, if not impossible.

SUMMARY OF THE INVENTION

An object of the present invention is to improve the toner cartridge of the above-described type so as to prevent toner leakage fully reliably.

Another object of the present invention is to provide a toner leakage preventing tape which can be applied to the toner cartridge of the above-described type, or other device or instrument in which toner leakage should be prevented, in order to effectively prevent the toner from leaking through a required site.

Still another object of the present invention is to improve the toner cartridge of the type in which a compressible seal member extending along the toner discharge opening is disposed on the outer surface of the container, and the compressible seal member is compressed between the outer surface of the container and the inner surface of the external member; whereby the external member can be moved fully easily relative to the container.

The inventor has conducted in-depth studies and experiments, and found the following facts to his surprise: A tape with a non-adherent surface having a coefficient of static friction $\mu_0$, against the surface of transparent glass, of 3.5 to 4.5 bonds to a required site in a toner cartridge or other device or instrument. As a result, the flow of the toner about to pass through the required site is effectively curtailed or inhibited by the surface of the tape, and thus leakage of the toner through the required site can be prevented fully reliably. The term "non-adherent" used in the instant specification means that when a member in intimate contact with the surface is moved in a direction substantially perpendicular to the surface, the force to resist this movement is substantially null, or if any, very low.

That is, an aspect of the present invention is to provide a toner cartridge comprising a container having a toner discharge opening formed therein, a toner accommodated in the container, and an external member combined with the container so as to be relatively movable between a closed position at which the external member closes the toner discharge opening and an open position at which the external member uncovers the toner discharge opening; wherein a toner leakage preventing tape is stuck to at least a part of that site of the inner surface of the external member which is opposed to the periphery of the toner discharge opening of the container when the external member is located at the closed position; and the surface of the toner leakage preventing tape is non-adherent and has a coefficient of static friction $\mu_0$, against the surface of a glazing, of 3.5 to 4.5.

If the surface of the toner leakage preventing tape is adherent, dust or dirt will deposit on the surface within a short period, and the outer surface of the container will adhere to the surface of the toner leakage preventing tape. Thus, the movement of the external member relative to the container will be inhibited. If the coefficient of static friction, $\mu_0$, of the surface of the toner leakage preventing tape is excessively small, the effect of curtailing or inhibiting the flow of the toner will be excessively lowered. If the coefficient of static friction, $\mu_0$, of the surface of the toner leakage preventing tape is excessively large, on the other hand, there will be an excessively high resistance when the external member is moved relative to the container having an outer surface in contact with or in intimate contact with the surface of the toner leakage preventing tape.

Another aspect of the present invention is to provide a toner leakage preventing tape to be stuck to the surface of a required site of a member in order to prevent leakage of a toner through the required site of the member; wherein the surface of the toner leakage preventing tape is non-adherent and has a coefficient of static friction $\mu_0$, against the surface of a glazing, of 3.5 to 4.5.

Preferably, the coefficient of static friction $\mu_0$ is 3.8 to 4.2. A preferred example of the toner leakage preventing tape is a plastic film coated with silicone rubber. In a preferred embodiment of the toner cartridge, the container is nearly cylindrical, and has the toner discharge opening formed in the peripheral surface thereof; the external member is a nearly cylindrical member into which the container is inserted concentrically, and the external member has a toner passage opening formed in the peripheral surface thereof; upon rotation of the external member relative to the container, the external member is brought to the closed position or the open position; when the external member is located at the closed position, the toner discharge opening and the toner passage opening do not overlap even partially, while when the external member is brought to the open position, the toner discharge opening and the toner passage opening overlap each other; and two toner leakage preventing tapes are stuck to the inner surface of the external member so as to extend arcuately opposite both sides, in the axial direction, of the toner discharge opening when the external member is located at the closed position. On the outer surface of the container, there is disposed a compressible seal member extending along the peripheral edge of the toner discharge opening, and the seal member has a surface layer of cloth.

Extensive studies and experiments by the inventor have also shown that the use of the compressible seal member having the surface layer of cloth does not affect the sealing properties of the toner cartridge, etc., fully reduces the friction between the surface of the seal member and the inner surface of the external member, and moves the external member easily relative to the container.

That is, still another aspect of the present invention is to provide a toner cartridge comprising a container having a toner discharge opening formed therein, a toner accommodated in the container, and an external member combined with the container so as to be relatively movable between a closed position at which the external member closes the toner discharge opening and an open position at which the external member uncovers the toner discharge opening; the toner cartridge including a compressible seal member disposed on the outer surface of the container so as to extend along the peripheral edge of the toner discharge opening, the seal member being compressed between the outer surface of the container and the inner surface of the external member; wherein the seal member has a surface layer of cloth.

Preferably, the seal member includes a main layer of a foam, especially, a polyurethane foam, and has the surface layer disposed on the surface of the main layer. Preferably, the surface layer is made of cloth formed from a thermoplastic material, especially a tricot fabric formed from nylon fibers, and is heat bonded to the surface of the main layer. In the preferred embodiment, the container is nearly cylindrical, and has the toner discharge opening formed in the peripheral surface thereof; the external member is a nearly cylindrical member into which the container is inserted concentrically, and the external member has a toner passage opening formed in the peripheral surface thereof; upon rotation of the external member relative to the container, the external member is brought to the closed position or the open position; when the external member is located at the closed position, the toner discharge opening and the toner passage opening do not overlap even partially, while when the external member is brought to the open position, the toner discharge opening and the toner passage opening overlap each other.

DETAILED DESCRIPTION OF THE PREFERRED EMBODIMENT

Preferred embodiments of a toner cartridge constructed in accordance with the present invention will now be described in detail with reference to the accompanying drawings.

Figure 1:
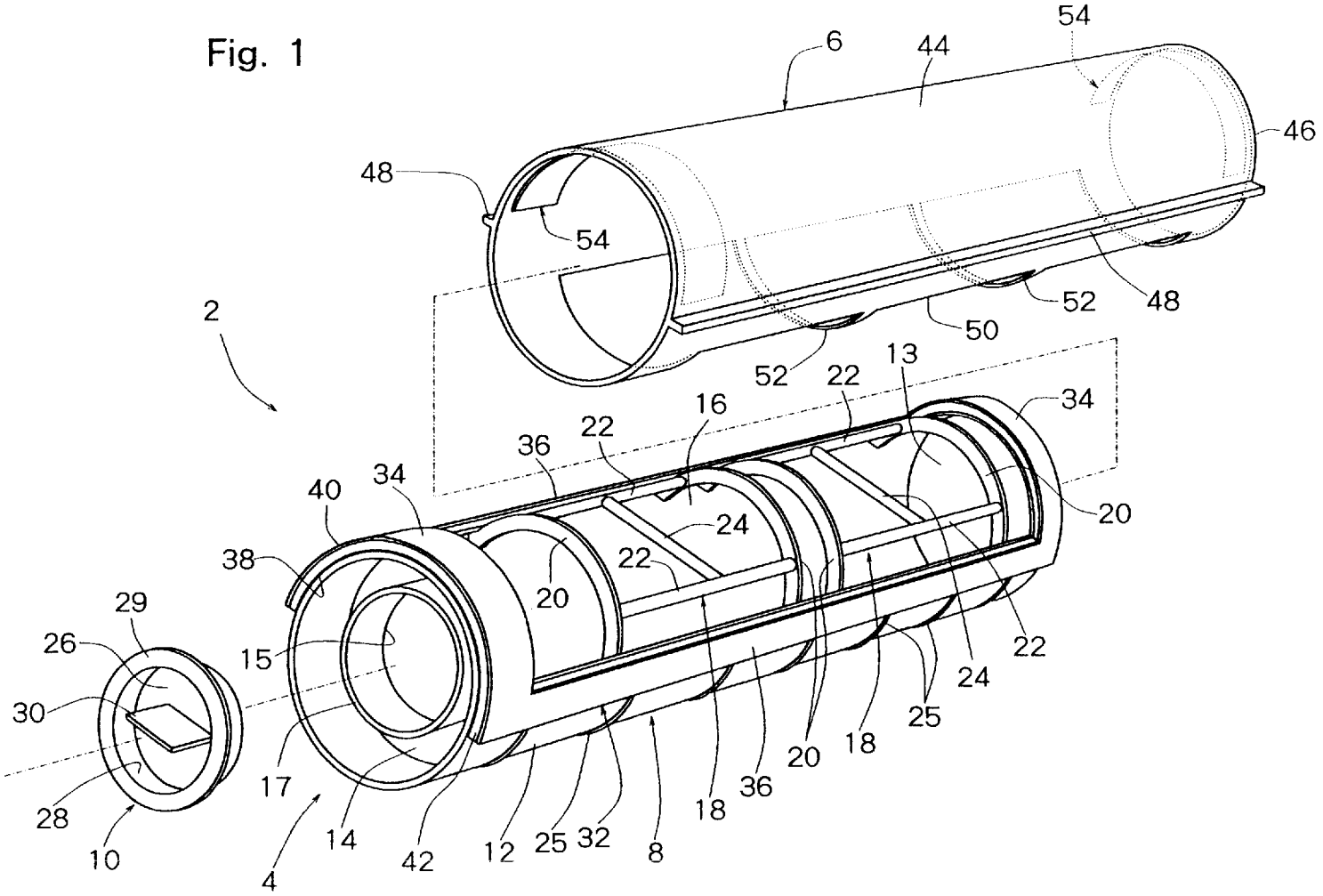
FIG. 1 is an exploded perspective view showing a preferred embodiment of a toner cartridge constructed in accordance with the present invention.
Figure 2:
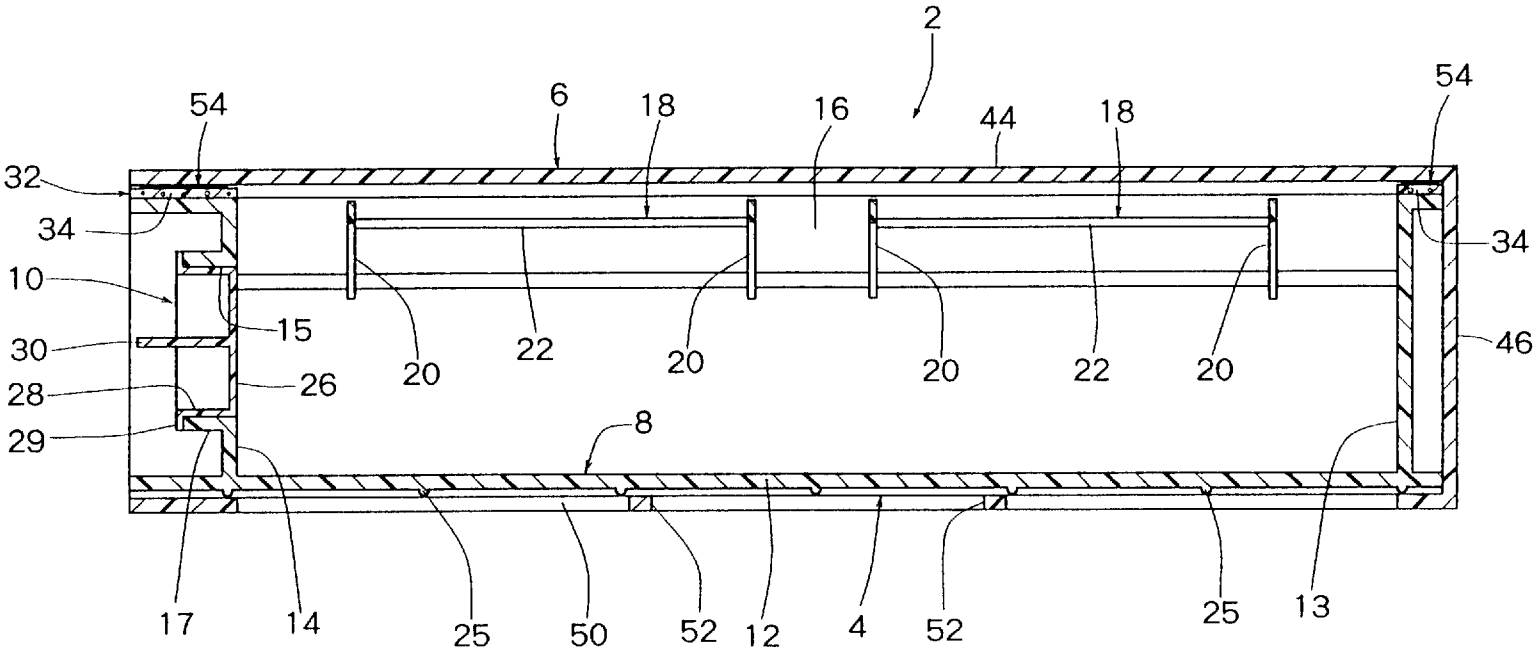
FIG. 2 is a sectional view of the toner cartridge shown in FIG. 1.

Referring to FIGS. 1 and 2, a toner cartridge entirely designated as 2 comprises a container 4 and an external member 6. The container 4 is composed of a body 8 and a closure 10. The body 8 which may be formed of a suitable plastic material has a slenderly extending, nearly cylindrical peripheral wall 12 and both end walls 13 and 14. As will be seen clearly by reference to FIG. 2, both end parts of the peripheral wall 12 protrude beyond the end walls 13 and 14. A toner fill opening 15 is formed in the end wall 14, which is provided with a cylindrical protruding wall 17 extending from the peripheral edge of the toner fill opening 15. In the peripheral wall 12 of the body 8, a toner discharge opening 16 is formed. The toner discharge opening 16, advantageously, extends between both end walls 13 and 14 in the axial direction (in other words, from a position substantially aligning with the inner surface of the end wall 13 to a position substantially aligning with the inner surface of the end wall 14), and extends over an angular range at about 80 to 110 degrees in the circumferential direction. In the toner discharge opening 16, a reinforcing rib 18 is disposed for making the peripheral wall 12 fully rigid. The reinforcing rib 18 in the illustrated embodiment has four arcuate portions 20 disposed with spacing in the axial direction and extending arcuately in the circumferential direction across the toner discharge opening 16, two pairs of linear portions 22, each pair extending in the axial direction between each couple of adjacent arcuate portions 20, and chord portions 24 each extending chordwise between the middle parts of the pair of linear portions 22. Such a reinforcing rib 18 can be formed separately from the body 8 of the container 4, and fixed at a required site by a suitable method such as mechanical engagement or bonding. Alternatively, the reinforcing rib 18 can be formed integrally with the body 8. On the outer surface of the peripheral wall 12 of the body 8, a plurality of arcuate ridges 25 are formed which extend circumferentially and with a suitable spacing in the axial direction. Each of the arcuate ridges 25 is not extended in a region where a seal member (to be described later on) is disposed. The closure 10 has a circular end wall 26, a short cylindrical wall 28 protruding outward from the peripheral edge of the end wall 26, and an annular flange wall 29 protruding radially outwardly from the short cylindrical wall 28. On the outer surface of the end wall 26, a projecting piece 30 which projects outward is formed. The outside diameter of the end wall 26 is substantially the same as the inside diameter of the cylindrical protruding wall 17 formed on the end wall 14 of the body 8. The closure 10, as will be mentioned further later on, closes the toner discharge opening 15 in the following manner: A toner is filled into the body 8 through the toner fill opening 15. Then, the circular end wall 26 and the short cylindrical wall 28 of the closure 10 are inserted into the cylindrical protruding wall 17 formed on the end wall 14 of the body 8, whereupon the closure 10 is fixed by a suitable method, such as heat bonding or adhesion, to close the toner discharge opening 15.

Figure 3:
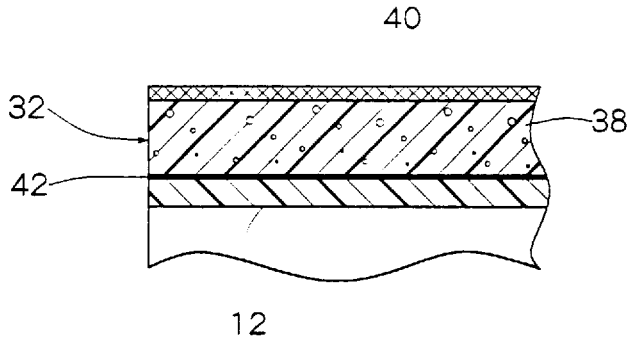
FIG. 3 is a partial sectional view showing a compressible seal member used in the toner cartridge shown in FIG. 1.

With reference to FIGS. 1 and 2, a compressible seal member 32 extending along the peripheral edge of the toner discharge opening 16 formed in the peripheral wall 12 is disposed on the surface of the peripheral wall 12 in the body 8 of the container 4. The seal member 32 has arcuate portions 34 extending along both terminal edges in the axial direction of the toner discharge opening 16, and linear portions 36 extending along both side edges in the circumferential direction of the toner discharge opening 16. It is important for the seal member 32 to have a surface layer of cloth. As will be clearly seen by reference to FIG. 3, the seal member 32 in the illustrated embodiment is composed of a compressible main layer 38, and a surface layer 40 disposed on the surface of the main layer 38. Preferably, the main layer 38 is formed of a foam, especially, a polyurethane foam. The preferred polyurethane foam is, for example, a product of BRIDGESTONE CORP. sold under the trade name "Everlight VA". The thickness of the main layer 38 may be about 2.5 to 3.5 mm. It is important for the surface layer 40 to be composed of a suitable cloth. Preferably, the surface layer 40 is made of a cloth formed from a thermoplastic material, especially, a tricot fabric formed from nylon fibers, and is heat bonded to the surface of the main layer 38. The seal member 32 consisting of the main layer 38 and the surface layer 40 may be joined to a required site of the peripheral wall 12 via an adhesive double coated tape 42.

With reference to FIGS. 1 and 2, an external member 6 which may be formed of a suitable plastic material has a slenderly extending cylindrical peripheral wall 44, and an end wall 46 which closes one end face thereof. The other end face of the external member 6 is open. The inside diameter of the peripheral wall 44 is set at a value about 2 to 3 mm larger than the outside diameter of the aforementioned peripheral wall 12 in the body 8 of the container 4. On the surface of the peripheral wall 44, a pair of stopper pieces 48 are formed so as to be disposed at an angular distance of 180 degrees. The stopper piece 48 is a plate-like piece protruding radially from the peripheral wall 44, and extends in the axial direction over nearly the whole length of the external member 6. In the peripheral wall 44 of the external member 6, a toner passage opening 50 is further formed. The axially extending length of the toner passage opening 50 may be substantially the same as the axially extending length of the toner discharge opening 16 formed in the body 8 of the container 4. The circumferentially extending angle of the toner passage opening 50 may also be substantially the same as the circumferentially extending angle of the toner discharge opening 16 formed in the body 8 of the container 4. In the toner passage opening 50, a reinforcing rib 52 is disposed for making the peripheral wall 44 fully rigid. The reinforcing rib 52 has a pair of arcuate portions disposed with spacing in the axial direction and extending in the circumferential direction. The reinforcing rib 52 can be formed integrally with the peripheral wall 44, or can be formed separately from the peripheral wall 44, and fixed at a required site by a suitable method such as mechanical engagement or bonding.

Figure 4:
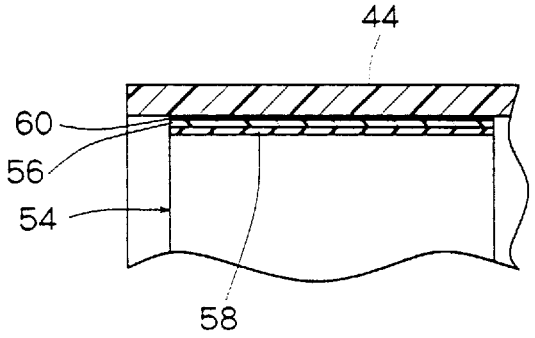
FIG. 4 is a partial sectional view showing a toner leakage preventing tape used in the toner cartridge shown in FIG. 1.

It is important that a toner leakage preventing tape 54 be stuck to a required site of the inner surface of the external member 6, namely, at least a part of the site opposed to the periphery of the toner discharge opening 16 formed in the peripheral wall 12 in the body 8 of the container 4 (accordingly, the site where the compressible seal member 32 is disposed in the illustrated embodiment) when the external member 6 combined with the container 4 as will be described later on is located at the closed position. Referring to FIG. 4 along with FIGS. 1 and 2, in the illustrated embodiment the toner leakage preventing tape 54 is stuck to the upper half each of the opposite end parts of the peripheral wall 44 of the external member 6. This toner leakage preventing tape 54 extends arcuately opposite both sides in the axial direction of the toner discharge opening 16 (accordingly, the arcuate portions 34 of the seal member 32), when the container 4 and the external member 6 are combined as required, and the external member 6 is brought to the closed position, in the manner to be described later on. Importantly, the toner leakage preventing tape 54 should have a surface which is non-adherent and has a coefficient of static friction $\mu_0$, against the surface of a glazing, of 3.5 to 4.5, preferably, 3.8 to 4.2. A preferred example of the toner leakage preventing tape 54 having such a surface is a tape comprising a plastic film 56, such as a polyester film, with a silicone rubber coating 58, e.g., a tape sold by Sumitomo 3M under the trade name "Scotch Roll Covering Tape No. 5461." The toner leakage preventing tape 54 may be stuck to a required site of the inner surface of the external member 6 via an adhesive double coated tape 60. If desired, the toner leakage preventing tape may also be stuck to those sites of the inner surface of the external member 6 which are opposed to both sides in the circumferential direction of the toner discharge opening 16 (accordingly, the linear portions 36 of the seal member 32).

The above-described container 4 and external member 6 are combined by inserting the container 4 into the external member 6 through the open end face of the external member 6. At this time, they are combined, for example, such that the container 4 is set at an angular position at which the toner discharge opening 16 formed in the peripheral wall 12 is directed upwards, while the external member 6 is set at an angular position at which the toner passage opening 50 formed in the peripheral wall 44 is directed downwards. Thus, as will be seen by reference to FIG. 2, the toner discharge opening 16 of the container 4 and the toner passage opening 50 of the external member 6 do not overlap even partially, and the toner discharge opening 16 of the container 4 is closed by the external member 6. In other words, the external member 6 is located at the closed position relative to the container 4. In this condition, the seal member 32 disposed on the surface of the peripheral wall 12 in the body 8 of the container 4 is compressed between the outer surface of the container 4, more specifically, the outer surface of the peripheral wall 12 in the body 8, and the inner surface of the external member 6, more specifically, the inner surface of the peripheral wall 44. As a result, the toner discharge opening 16 is sealed. In that region of the peripheral wall 12 in the body 8 of the container 4 which is other than the toner discharge opening 16 and the seal member 32, the plurality of arcuate ridges 25 are contacted with the inner surface of the peripheral wall 44 of the external member 6. By bringing only the arcuate ridges 25 into contact with the inner surface of the peripheral wall 44, rather than contacting the whole outer surface of the peripheral wall 12 with the inner surface of the peripheral wall,44, the frictional resistance during the relative movement of the peripheral wall 12 and the peripheral wall 44 is restricted to a sufficiently low value. After combining the container 4 and the external member 6 in the above manner, a toner (not shown to avoid the possible obscurity of the drawing) is filled into the container 4 through the toner fill opening 15 formed in the end wall 14 in the body 8 of the container 4. Then, as illustrated in FIG. 2, the closure 10 is fixed to the protruding wall 17 formed in the end wall 14 in the body 8 of the container 4 to close the toner fill opening 15, thereby completing the toner cartridge 2.

As described above, when the external member 6 is located at the closed position, the toner discharge opening 16 of the container 4 is closed with the external member 6, and the compressible seal member 32 extending along the peripheral edge of the toner discharge opening 16 of the container 4 is compressed between the outer surface of the container 4 and the inner surface of the external member 6. This is an apparent preventive measure against the drain of the toner through the toner discharge opening 16 and its leakage to the outside of the toner cartridge 2. According to the inventor's experience, however, if the toner leakage preventing tape 54 is not disposed, the toner may flow through the gap between the inner surface of the external member 6 and the surface of the seal member 32, for example, when the toner cartridge 2 is vibrated. Consequently, the toner may leak to the outside of the toner cartridge 2. When the toner leakage preventing tape 54 is disposed, possible flow of the toner through the gap between the inner surface of the external member 6 and the surface of the seal member 32 is fully curtailed or inhibited by the frictional resistance of the surface of the toner leakage preventing tape 54. Thus, leakage of the toner to the outside of the toner cartridge 2 is prevented fully reliably. To curtail or inhibit the flow of the toner fully effectively, it is important that the coefficient of static friction $\mu_0$ of the surface of the toner leakage preventing tape 54 be sufficiently large, say, as large as 3.5 or more, preferably, 3.8 or more.

The above-described toner cartridge 2 is mounted detachably at a required site of a developing device (not shown), optionally of a well known type per se, designed to apply a toner to a latent electrostatic image to develop it to a toner image. When the toner cartridge 2 is mounted at the required site of the developing device, the pair of stopper pieces 48 formed on the external member 6 are constrained by a suitable constraining means (not shown) disposed in the developing device, whereby the external member 6 is constrained to be nonrotatable. Then, the projecting piece 30 disposed in the closure 10 of the container 4 is gripped to rotate the container 4 through about 180 degrees. By so doing, the toner discharge opening 16 formed in the container 4 is changed from the upwardly directed state to a downwardly directed state, and aligned with the toner passage opening 50 of the external member 6. In other words, the external member 6 is rotated through about 180 degrees relative to the container 4 to be brought to the open position. Thus, the toner passage opening 50 of the external member 6 and the toner discharge opening 16 of the container 4 overlap each other, whereupon the toner discharge opening 16 is exposed to the outside through the toner passage opening 50. As a result, the toner accommodated in the container 4 is discharged through the toner discharge opening 16 and the toner passage opening 50, and supplied to a required place of the developing device. When the toner accommodated in the container 4 is substantially used up, the container 4 is rotated through about 180 degrees to return the toner discharge opening 16 to an upwardly directed state. In other words, the external member 6 is rotated through 180 degrees relative to the container 4 to be brought to the closed position. Thus, the toner discharge opening 16 is sealed again by the external member 6 and the seal member 32. Then, the toner cartridge is removed from the developing device.

In the toner cartridge 2 constructed in accordance with the present invention, the compressible seal member 32 has the surface layer 40 of cloth. Hence, the frictional resistance of the seal member 32 to the inner surface of the peripheral wall 44 of the external member 6 is markedly reduced. In addition, the surface of the toner leakage preventing tape 54 is non-adherent and has a coefficient of static friction $\mu_0$ of 4.5 or less, preferably, 4.2 or less. Therefore, when the container 4 and the external member 6 are to be assembled, the container 4 can be inserted sufficiently easily into the external member 6, without causing problems such as damage to the seal member 32. Furthermore, the external member 6 is rotated sufficiently easily relative to the container 4, whereby it can be brought to the open or closed position. If the surface of the toner leakage preventing tape 54 is adherent or has an excessively large coefficient of static friction $\mu_0$, the relative movement of the toner leakage preventing tape 54 and the seal member 32 in intimate contact therewith is considerably impeded, so that it becomes very hard to move the external member 6 relative to the container 4.

The toner cartridge 2 with the toner leakage preventing tape 54 has been described in detail. However, the toner leakage preventing tape with the surface having the desired properties is not restricted to use in a toner cartridge. This toner leakage preventing tape can also be used effectively to curtail or inhibit the flow of the toner through the gap between two members which need to be relatively moved in another mechanism of a developing device or a cleaning device in an image forming machine.

While the preferred embodiments of the toner cartridge constructed in accordance with the present invention have been described in detail with reference to the accompanying drawings, it is to be understood that the invention is not restricted to these embodiments, and various changes and modifications may be made without departing from the spirit and scope of the invention.

What I claim is:

1. A toner cartridge comprising a container having a toner discharge opening formed therein, a toner accommodated in the container, and an external member combined with the container so as to be relatively movable between a closed position at which the external member closes the toner discharge opening and an open position at which the external member uncovers the toner discharge opening; wherein a toner leakage preventing tape is stuck to at least a part of that site of an inner surface of the external member which is opposed to a periphery of the toner discharge opening of the container when the external member is located at the closed position; and a surface of the toner leakage preventing tape is non-adherent and has a coefficient of static friction $\mu_0$, against a surface of a glazing, of 3.5 to 4.5.

2. The toner cartridge of claim 1, wherein the coefficient of static friction $\mu_0$ is 3.8 to 4.2.

3. The toner cartridge of claim 1, wherein the toner leakage preventing tape comprises a plastic film coated with silicone rubber.

4. The toner cartridge of claim 1, wherein the container is nearly cylindrical, and has the toner discharge opening formed in a peripheral surface thereof; the external member is a nearly cylindrical member into which the container is inserted concentrically, and the external member has a toner passage opening formed in a surface thereof; upon rotation of the external member relative to the container, the external member is brought to the closed position or the open position; when the external member is located at the closed position, the toner discharge opening and the toner passage opening do not overlap even partially, while when the external member is brought to the open position, the toner discharge opening and the toner passage opening overlap each other; and two toner leakage preventing tapes are stuck to the inner surface of the external member so as to extend arcuately opposite both sides, in an axial direction, of the toner discharge opening when the external member is located at the closed position.

5. The toner cartridge of claim 1, wherein a compressible seal member extending along a peripheral edge of the toner discharge opening is disposed on an outer surface of the container, and the seal member has a surface layer of cloth.

6. A toner leakage preventing tape to be stuck to a surface of a required site of a member in order to prevent leakage of a toner through the required site of the member; wherein a surface of the toner leakage preventing tape is non-adherent and has a coefficient of static friction $\mu_0$, against a surface of a glazing, of 3.5 to 4.5.

7. The toner leakage preventing tape of claim 6, wherein the coefficient of static friction $\mu_0$ is 3.8 to 4.2.

8. The toner leakage preventing tape of claim 6, comprising a plastic film coated with silicone rubber.

9. A toner cartridge comprising a container having a toner discharge opening formed therein, a toner accommodated in the container, and an external member combined with the container so as to be relatively movable between a closed position at which the external member closes the toner discharge opening and an open position at which the external member uncovers the toner discharge opening; said toner cartridge including a compressible seal member disposed on an outer surface of the container so as to extend along a peripheral edge of the toner discharge opening, said seal member being compressed between the outer surface of the container and an inner surface of the external member; wherein the seal member has a surface layer of cloth.

10. The toner cartridge of claim 9, wherein the seal member includes a main layer of a foam, and has a surface layer disposed on the surface of the main layer.

11. The toner cartridge of claim 10, wherein the main layer is a polyurethane foam.

12. The toner cartridge of claim 10, wherein the surface layer is made of cloth formed from a thermoplastic material, and is heat bonded to the surface of the main layer.

13. The toner cartridge of claim 12, wherein the surface layer is made of a tricot fabric formed from nylon fibers.

14. The toner cartridge of claim 9, wherein the container is nearly cylindrical, and has the toner discharge opening formed in a peripheral surface thereof; the external member is a nearly cylindrical member into which the container is inserted concentrically, and the external member has a toner passage opening formed in a peripheral surface thereof; upon rotation of the external member relative to the container, the external member is brought to the closed position or the open position; when the external member is located at the closed position, the toner discharge opening and the toner passage opening do not overlap even partially, while when the external member is brought to the open position, the toner discharge opening and the toner passage opening overlap each other.

* * * * *